US012091860B2

(12) United States Patent
Brochu

(10) Patent No.: US 12,091,860 B2
(45) Date of Patent: Sep. 17, 2024

(54) GUTTER ASSEMBLY AND METHOD FOR INSTALLING A GUTTER

(71) Applicant: Stephane Brochu, Lévis (CA)

(72) Inventor: Stephane Brochu, Lévis (CA)

( * ) Notice: Subject to any disclaimer, the term of this patent is extended or adjusted under 35 U.S.C. 154(b) by 0 days.

(21) Appl. No.: 17/863,497

(22) Filed: Jul. 13, 2022

(65) Prior Publication Data

US 2023/0027949 A1 Jan. 26, 2023

Related U.S. Application Data

(60) Provisional application No. 63/203,265, filed on Jul. 15, 2021.

(51) Int. Cl.
*E04D 13/072* (2006.01)
*E04D 13/076* (2006.01)

(52) U.S. Cl.
CPC ..... *E04D 13/0725* (2013.01); *E04D 13/0722* (2013.01); *E04D 13/076* (2013.01)

(58) Field of Classification Search
CPC ..... E04D 13/076; E04D 13/0722; E04D 13/0685; E04D 13/0725; E04D 13/068
USPC ..... 248/48.2
See application file for complete search history.

(56) References Cited

U.S. PATENT DOCUMENTS 485,573 A * 11/1892 Bonbrake ..... E04D 13/068 405/121
498,286 A * 5/1893 Moore ..... E04D 13/068 405/121
524,186 A * 8/1894 Silberstein ..... E04D 13/0722 248/48.1
559,942 A * 5/1896 Horan ..... E04D 13/076 248/48.2
706,333 A * 8/1902 Meuser ..... E04D 13/076 52/12
914,650 A * 3/1909 Feyler ..... E04D 13/076 24/339
1,138,657 A * 5/1915 Wrightsman ..... E04D 13/068 248/48.1

(Continued)

FOREIGN PATENT DOCUMENTS

CA 2305159 A1 10/2001
CA 2451186 A1 1/2003

(Continued)

*Primary Examiner* — Taylor Morris
(74) *Attorney, Agent, or Firm* — Reising Ethington P.C.

(57) ABSTRACT

A gutter assembly comprising: a gutter having a gutter wall extending between front and rear gutter wall ends and defining a gutter channel, the gutter wall further having an inner face delimiting the gutter channel and an outer face; at least one bracket member sized and shaped to conform to the outer face of the gutter wall, each bracket member including front and rear bracket connecting portions connectable respectively to the front and rear gutter wall ends; a gutter cover comprising front and rear cover mounting portions and a central cover portion extending therebetween, the front cover mounting portion being engageable with at least one of the front gutter wall portion and the front connecting end of the bracket member, and the rear cover mounting portion being engageable with at least one of the rear gutter wall portion and the rear connecting end of the bracket member.

25 Claims, 8 Drawing Sheets

(56) References Cited

U.S. PATENT DOCUMENTS 1,438,774 A * 12/1922 Meunier ..... E04D 13/0725 248/48.2
1,508,215 A * 9/1924 Bydall ..... E04D 13/0725 248/48.1
1,571,277 A * 2/1926 Knab ..... E04D 13/0722 248/245
D90,272 S 7/1933 White
2,187,869 A * 1/1940 Tobin ..... E04D 13/0722 248/48.1
2,219,953 A * 10/1940 Fry ..... E04D 13/0722 52/12
2,271,081 A * 1/1942 Layton ..... E04D 13/076 52/12
2,277,443 A 3/1942 Livingston
2,399,197 A * 4/1946 Boyd ..... E04D 13/0722 248/48.2
2,536,704 A * 1/1951 Shea ..... E04D 13/0722 248/48.2
2,550,780 A * 5/1951 Cohn ..... E04D 13/0725 248/48.1
2,647,476 A * 8/1953 Gibbons ..... E04D 13/068 248/48.1
2,717,752 A * 9/1955 Pollock ..... E04D 13/0725 248/48.1
2,873,700 A * 2/1959 Heier ..... E04D 13/076 52/12
3,042,742 A 7/1962 Foster
3,053,393 A * 9/1962 Mclean ..... E04D 13/076 52/12
3,060,638 A * 10/1962 Bender ..... E04D 13/068 52/11
3,295,803 A 1/1967 Blayden
3,297,285 A * 1/1967 Simmons ..... E04D 13/076 248/48.1
3,436,878 A 4/1969 Singer
3,841,101 A * 10/1974 Henfrey ..... E04D 13/068 405/122
4,142,370 A * 3/1979 Giordano ..... E04D 13/0641 52/11
4,190,988 A * 3/1980 Carreiro ..... E04D 13/0641 52/16
4,241,548 A 12/1980 Rowe
4,395,852 A * 8/1983 Tang ..... E04D 13/076 52/12
4,808,234 A 2/1989 McKay et al.
4,820,407 A 4/1989 Lilie
5,044,581 A * 9/1991 Dressler ..... E04D 13/076 52/12
5,092,086 A * 3/1992 Rognsvoog, Sr. .... E04D 13/076 52/12
5,271,192 A * 12/1993 Nothum, Sr. ..... E04D 13/076 52/12
5,406,754 A 4/1995 Cosby
5,617,678 A * 4/1997 Morandin ..... E04D 13/0725 52/12
5,619,825 A 4/1997 Leroney et al.
5,744,218 A 4/1998 Barnes
5,906,287 A 5/1999 Kohnen
6,134,843 A 10/2000 Tregear
D460,197 S 7/2002 Stringer
6,427,388 B1 8/2002 Brochu
D468,446 S 1/2003 Sender et al.
6,701,674 B1 3/2004 Albracht
6,786,008 B2 * 9/2004 Brochu ..... E04D 13/076 52/12
6,826,872 B2 * 12/2004 Brochu ..... E04D 13/076 52/12
6,931,792 B2 * 8/2005 McDonald ..... E04D 13/076 52/12
D523,538 S 6/2006 Brochu
D532,969 S 6/2006 Abruzese et al.
D551,740 S 9/2007 Riley
D558,309 S 12/2007 Gregg
D569,011 S 5/2008 Brochu
7,418,801 B2 * 9/2008 Loveless ..... E04D 13/0722 248/48.2
7,614,185 B2 11/2009 Brochu
7,624,541 B2 12/2009 Gentry
7,658,036 B2 2/2010 Banks et al.
7,765,743 B2 8/2010 Guilford
7,908,797 B2 3/2011 Graves
7,913,458 B2 3/2011 Higginbotham
8,037,641 B2 10/2011 Gerig
D651,292 S 12/2011 Geers
8,191,315 B1 6/2012 Brochu
8,316,585 B2 * 11/2012 Brochu ..... E04D 3/364 52/12
8,322,082 B2 12/2012 Neumann
8,347,557 B2 1/2013 Minor, Sr. et al.
8,375,644 B2 2/2013 Robins
D677,405 S 3/2013 Landis
8,434,269 B1 5/2013 Brochu
8,479,454 B2 7/2013 Lenney et al.
8,578,658 B2 * 11/2013 Snell ..... E04D 13/076 52/12
8,621,821 B1 * 1/2014 Wallace, Jr. ..... E04D 15/00 52/749.1
8,635,811 B2 1/2014 Horton
8,695,282 B2 * 4/2014 Glander ..... E04D 13/076 52/12
8,776,444 B2 7/2014 Beck et al.
D719,648 S 12/2014 Moody et al.
D721,826 S 1/2015 Ryan
8,950,122 B2 * 2/2015 Degenhardt ..... E04D 13/076 52/12
D723,671 S 3/2015 Brochu
8,997,403 B1 4/2015 Steinberg et al.
9,010,029 B2 4/2015 Higginbotham
9,010,030 B2 4/2015 Davis
D736,900 S 8/2015 Frelier
9,127,463 B1 9/2015 Feldhaus
9,163,406 B1 10/2015 Ealer, Sr.
D742,541 S 11/2015 Ryan
D770,603 S 11/2016 Fryml
D782,624 S 3/2017 Haendel
D792,985 S 7/2017 Jones
D796,067 S 8/2017 Landis et al.
10,100,522 B2 10/2018 Beck et al.
10,519,667 B1 * 12/2019 Ealer, Sr. ..... B21D 47/005
11,060,293 B2 7/2021 Graves
11,661,747 B2 * 5/2023 Brochu ..... E04D 13/0685 52/12
2003/0110712 A1 6/2003 Brochu
2004/0060244 A1 4/2004 Brochu
2004/0118052 A1 6/2004 Brochu
2004/0182014 A1 9/2004 Brochu
2004/0244302 A1 12/2004 Neumann
2005/0028452 A1 2/2005 Brochu
2005/0115160 A1 6/2005 Brochu
2005/0193642 A1 9/2005 Brochu et al.
2005/0193671 A1 9/2005 Brochu et al.
2005/0204642 A1 * 9/2005 Valentini ..... E04D 13/076 52/12
2005/0223657 A1 10/2005 Brochu et al.
2005/0279036 A1 12/2005 Brochu
2006/0037254 A1 2/2006 Brochu
2006/0037255 A1 2/2006 Brochu
2006/0123710 A1 6/2006 Lenney et al.
2006/0283097 A1 12/2006 Gregg
2007/0167130 A1 7/2007 Brochu
2007/0169423 A1 7/2007 Brochu
2008/0010906 A1 1/2008 Brochu
2008/0163561 A1 7/2008 Lenney et al.
2008/0190039 A1 8/2008 Brochu
2008/0190070 A1 8/2008 Duncan et al.
2008/0289263 A1 11/2008 Brochu
2009/0013612 A1 1/2009 Brochu
2009/0056234 A1 3/2009 Brochu
2009/0108144 A1 4/2009 Brochu
2010/0287846 A1 11/2010 Lenney
2011/0056145 A1 3/2011 Lenney

(56) References Cited

U.S. PATENT DOCUMENTS

| | | | | |
|---|---|---|---|---|
| 2011/0067317 | A1 | 3/2011 | Hedrick | |
| 2011/0067318 | A1 | 3/2011 | Lenney et al. | |
| 2011/0138698 | A1 | 6/2011 | Neumann | |
| 2012/0151849 | A1 | 6/2012 | Brochu | |
| 2013/0091780 | A1 | 4/2013 | Robins | |
| 2014/0069028 | A1 | 3/2014 | Lenney | |
| 2014/0215929 | A1 | 8/2014 | Lenney | |
| 2015/0020462 | A1 | 1/2015 | Iannelli | |
| 2015/0040488 | A1 | 2/2015 | Lenney | |
| 2015/0143756 | A1 | 5/2015 | Higginbotham | |
| 2015/0225959 | A1 | 8/2015 | Lenney | |
| 2015/0330085 | A1 | 11/2015 | Iannelli | |
| 2016/0060870 | A1 | 3/2016 | Martin | |
| 2016/0369512 | A1 | 12/2016 | Lenney | |
| 2017/0204611 | A1* | 7/2017 | Brochu | E04D 13/076 |
| 2018/0030733 | A1 | 2/2018 | Brochu | |
| 2019/0071874 | A1* | 3/2019 | Brochu | H02K 21/024 |
| 2020/0157820 | A1 | 5/2020 | Lenney | |
| 2021/0285224 | A1 | 9/2021 | Graves | |
| 2022/0136250 | A1* | 5/2022 | Brochu | E04D 13/068 52/12 |

FOREIGN PATENT DOCUMENTS

| | | | | |
|---|---|---|---|---|
| CA | 2405756 | A1 | 3/2004 | |
| CA | 2458005 | A1 | 8/2005 | |
| CA | 2460429 | A1 | 9/2005 | |
| CA | 2541186 | A1 | 7/2007 | |
| CA | 2593808 | A1 | 1/2009 | |
| CA | 2608530 | A1 | 4/2009 | |
| CA | 2747704 | A1 | 7/2009 | |
| CA | 2723499 | A1 | 3/2011 | |
| CA | 2727844 | A1 * | 7/2012 | E04D 13/076 |
| CA | 2747513 | A1 | 1/2013 | |
| CA | 2783834 | A1 | 8/2013 | |
| CA | 2775864 | A1 | 11/2013 | |
| CA | 2933239 | A1 | 7/2015 | |
| CA | 2863023 | A1 | 3/2016 | |
| CA | 166698 | S | 8/2016 | |
| CA | 169577 | S | 2/2017 | |
| CA | 2907280 | A1 | 2/2017 | |
| CA | 2955268 | A1 | 7/2017 | |
| CA | 2919709 | A1 | 8/2017 | |
| CA | 2963962 | A1 | 10/2017 | |
| CA | 2931540 | A1 | 11/2017 | |
| CA | 175672 | S | 4/2018 | |
| CA | 2985004 | A1 * | 5/2018 | E04D 13/076 |
| CA | 3016527 | A1 | 3/2019 | |
| CA | 3023339 | A1 * | 5/2019 | E04D 13/068 |
| CA | 3045555 | A1 | 12/2020 | |
| CA | 3136440 | A1 * | 4/2022 | E04D 13/068 |
| DE | 2139825 | A1 * | 2/1973 | E04D 13/0722 |
| DE | 3905961 | A1 * | 9/1989 | E04D 13/076 |
| DE | 3829384 | A1 * | 3/1990 | E04D 13/076 |
| DE | 29823421 | U1 * | 6/1999 | E04D 13/076 |
| DE | 102004052529 | A1 * | 12/2005 | E04D 13/0722 |
| DE | 102006056737 | A1 * | 5/2008 | E04D 13/0722 |
| EP | 1449980 | A1 | 8/2004 | |
| EP | 1627974 | A2 | 2/2006 | |
| EP | 2159342 | A1 | 3/2010 | |
| EP | 2177685 | A1 | 4/2010 | |
| EP | 2251500 | A1 | 11/2010 | |
| FR | 2571411 | A1 * | 4/1986 | E04D 13/0722 |
| FR | 2731453 | A3 * | 9/1996 | E04D 13/0722 |
| GB | 2084210 | A * | 4/1982 | E04D 13/076 |
| GB | 2481033 | A | 12/2011 | |
| GB | 2493284 | A | 1/2013 | |
| KR | 20100051168 | A * | 5/2010 | E04D 13/0645 |
| NL | 9200254 | A * | 9/1993 | E04D 13/0722 |
| WO | WO-8801668 | A1 * | 3/1988 | E04D 13/0275 |
| WO | 2007100320 | A1 | 9/2007 | |
| WO | 2008134845 | A1 | 11/2008 | |
| WO | 2009150174 | A1 | 12/2009 | |
| WO | WO-2015048116 | A1 * | 4/2015 | E04D 13/072 |

* cited by examiner

GUTTER ASSEMBLY AND METHOD FOR INSTALLING A GUTTER

CROSS-REFERENCE TO RELATED APPLICATION(S)

The present application claims priority from U.S. Provisional Patent Application No. 63/203,265, filed on Jul. 15, 2021, the entire specification of which is incorporated herein by reference.

TECHNICAL FIELD

The technical field generally relates to gutter assemblies, and more specifically to gutter assemblies including a gutter cover and a gutter and to methods for installing a gutter.

BACKGROUND

Rain gutters are useful to collect rainwater that runs off the roof of a house or of a building and to route collected rainwater away from the foundation to a proper drainage area in order to avoid damages to the foundation, the soffit, the windows and/or the doors, for instance. Rain gutters generally include a trough channeling the rainwater to a downpipe or downspout, the trough being affixed to a supporting structure of the house or building such as the fascia board.

Leaves and debris may accumulate within the trough of the gutter, which can prevent the rainwater from flowing through the trough. Gutter guards or gutter covers are used to protect the gutter by preventing leaves and debris from enter the trough of the gutter while still permitting rainwater to enter the trough.

Some gutters are further mounted to a surface, such as a wall and/or a roof of a building, using a plurality of mounting hooks which support the gutter. In existing systems, the hooks are usually positioned in alignment with each other along the surface and secured to the surface, and the gutter is then mounted on the mounting hooks. In addition to supporting the gutter, the mounting hooks may provide a visual appearance which may be aesthetically pleasing to some users.

SUMMARY

According to one aspect, there is provided a gutter assembly comprising: a gutter having a gutter wall extending between a front gutter wall end and a rear gutter wall end, the gutter wall defining a gutter channel having an open top, the gutter wall further having an inner face delimiting the gutter channel and an outer face; at least one bracket member sized and shaped to conform to the outer face of the gutter wall, each bracket member including front and rear bracket connectors connectable respectively to the front and rear gutter wall ends for attaching the bracket member to the gutter to form a bracketed gutter subassembly including the gutter and the at least one bracket member; a gutter cover for covering the open top of the gutter, the gutter cover comprising front and rear cover mounting portions and a central cover portion extending between the front and rear cover mounting portions, the front cover mounting portion being engageable with at least one of the front gutter wall end and the front bracket connector, and the rear cover mounting portion being engageable with at least one of the rear gutter wall end and the rear bracket connector to attach the gutter cover to the bracketed gutter subassembly.

In at least one embodiment, the at least one bracket member includes a plurality of bracket members disposed along the gutter and spaced apart from each other in a longitudinal direction.

In at least one embodiment, the gutter wall has a first stiffness and each bracket member has a second stiffness greater than the first stiffness such that the bracketed gutter assembly is stiffer than the gutter.

In at least one embodiment, each bracket member includes a base panel extending substantially parallel to the outer face of the gutter wall and an outer rib member extending away from the base panel.

In at least one embodiment, the outer rib member extends substantially perpendicularly to the base panel.

In at least one embodiment, the gutter wall is curved.

In at least one embodiment, the gutter wall is substantially semicircular.

In at least one embodiment, the gutter wall is made from a single piece of sheet metal.

In at least one embodiment, the gutter includes a front gutter connector engageable with the at least one bracket members to connect the gutter and the bracket members together.

In at least one embodiment, the front cover mounting portion is configured for engaging both the front gutter connector of the gutter located at the front gutter wall end and the front bracket connector.

In at least one embodiment, the front connector includes a front lip extending frontwardly from the gutter wall at the front gutter wall end.

In at least one embodiment, the front lip includes a front lip segment folded at an acute angle relative to the gutter wall at the front gutter wall end, thereby forming a front lip elbow between the front lip segment and the gutter wall.

In at least one embodiment, the front lip segment extends forwardly and is folded downwardly.

In at least one embodiment, the front bracket connecting portion includes a hook member sized and shaped to receive therein the front lip elbow.

In at least one embodiment, the front bracket connecting portion further includes: a bottom segment extending frontwardly; and an upright segment extending upwardly and rearwardly from the bottom segment, the hook member extending rearwardly from the upright segment.

In at least one embodiment, the upright segment is angled relative to the bottom segment so as to extend against the front lip segment and parallel thereto when the front bracket connecting portion engages the front gutter connector.

In at least one embodiment, the front cover mounting portion includes a front receptacle sized and shaped to receive at least one of the front bracket connector and the front gutter connector therein.

In at least one embodiment, the front cover mounting portion entirely covers the front gutter connector and the front bracket connector when the front gutter connector and the front bracket connector are engaged in the front cover mounting portion.

In at least one embodiment, the front receptacle is sized and shaped to receive both the front bracket connector and the front gutter connector therein.

In at least one embodiment, the front receptacle includes a plurality of segments, at least one of the plurality of segments abutting at least one of the gutter wall, the front gutter connector and the front bracket connector to hold the front gutter connector in the front receptacle.

In at least one embodiment, the plurality of segments includes a first segment extending upwardly and slightly forwardly from a front end of the central cover portion and a second segment extending upwardly and slightly rearwardly from the first segment, the first and second segments being angled relative to each other to form an apex therebetween, the first and second segments being sized and shaped such that the apex abuts the gutter wall when the front gutter connector and the front bracket connector are received in the front receptacle.

In at least one embodiment, the front receptacle further includes a face panel extending forwardly and downwardly and curving back rearwardly and downwardly, and an end segment extending upwardly and rearwardly from the curved portion, the end segment abutting the front bracket connector when the front bracket connector is received in the front receptacle.

In at least one embodiment, the front bracket connector is shaped to conform to the front cover mounting portion and extends along an exterior of the front cover mounting portion.

In at least one embodiment, the front bracket connector terminates in a hook member which engages the front cover mounting portion.

In at least one embodiment, the front cover mounting portion has a front mounting portion end which is spaced from the gutter wall.

In at least one embodiment, the rear cover mounting portion is configured for engaging both a rear gutter connector of the gutter located at the rear gutter wall end and the rear bracket connector.

In at least one embodiment, the rear bracket connector includes a vertical wall portion and a forwardly-extending protrusion defined in the vertical wall portion.

In at least one embodiment, the rear cover mounting portion includes a bracket engaging portion which has an inverted U-shape for straddling the vertical wall portion.

In at least one embodiment, the bracket engaging portion includes first and second vertical segments folded at a substantially 180-degree angle relative to each other.

In at least one embodiment, the rear cover mounting portion further includes a hook portion located below the bracket engaging portion and engageable with the forwardly-extending protrusion of the rear bracket connector.

In at least one embodiment, the hook portion is formed by a fold in the gutter cover and extends rearwardly and upwardly so as to abut the forwardly-extending protrusion.

In at least one embodiment, the central cover portion is substantially planar and has a plurality of drainage through-holes, not shown, defined therein to allow liquid such as rainwater to enter the gutter through its open top.

In at least one embodiment, the central cover portion is double-walled and includes an upper panel and a lower panel spaced vertically from the upper panel.

In at least one embodiment, the upper panel is integrally formed with the front and rear cover mounting portions and the lower panel is provided as a distinct piece which is attachable to the upper panel.

In at least one embodiment, the gutter assembly further includes at least one extension member distinct from the bracket member and positionable in alignment with a corresponding one of the at least one bracket member to form an upward extension to the corresponding one of the at least one bracket member.

In at least one embodiment, the bracket extension member is attachable to the front cover mounting portion.

According to another aspect, there is also provided a method for installing a gutter on a surface, the method comprising: attaching at least one bracket member to the gutter to form a bracketed gutter subassembly including the at least one bracket member and the gutter, each bracket member being sized and shaped to conform to an outer face of the gutter; attaching a gutter cover to the bracketed gutter subassembly such that the gutter cover extends over an open top of the gutter; positioning the bracketed gutter subassembly at a desired position against the surface; securing the bracketed subassembly to the surface.

In at least one embodiment, attaching the at least one bracket member to the gutter comprises attaching a plurality of bracket members to the gutter at desired positions along the gutter.

In at least one embodiment, attaching the gutter cover to the bracketed gutter subassembly includes engaging both a front bracket connector of the bracket and a front gutter connector of the gutter in a front cover mounting portion of the gutter cover such that both the front bracket connector and the front gutter connector are entirely covered by the front cover mounting portion.

According to another aspect, there is also provided a gutter assembly comprising: a gutter having a gutter wall extending between a front gutter wall end and a rear gutter wall end, the gutter wall defining a gutter channel having an open top, the gutter wall further having an inner face delimiting the gutter channel and an outer face; a gutter cover for covering the open top of the gutter, the gutter cover comprising front and rear cover mounting portions and a central cover portion extending between the front and rear cover mounting portions, the front cover mounting portion being engageable with the front gutter wall portion, and the rear cover mounting portion being engageable with the front gutter wall portion and the front connecting end of the bracket member to attach the gutter cover to the gutter, the front cover mounting portion including a face panel including a curved portion extending convexly frontwardly from the gutter.

In at least one embodiment, the gutter includes a front gutter connector located at the front gutter wall end and engageable in the front cover mounting portion.

In at least one embodiment, the front cover mounting portion being sized and shaped to entirely cover the front gutter connector when the front gutter connector is engaged in the front cover mounting portion.

In at least one embodiment, the front cover mounting portion includes a front receptacle comprising the face panel, the front receptacle further including a plurality of segments, at least one of the plurality of segments abutting the gutter wall proximal the front gutter wall end to hold the front gutter connector in the front receptacle.

In at least one embodiment, the plurality of segments includes a first segment extending upwardly and slightly forwardly from a front end of the central cover portion and a second segment extending upwardly and slightly rearwardly from the first segment, the first and second segments being angled relative to each other to form an apex therebetween, the first and second segments being sized and shaped such that the apex abuts the gutter wall when the front gutter connector is received in the front receptacle.

In at least one embodiment, the front receptacle further includes an end segment extending upwardly and rearwardly from the curved portion of the face panel.

In at least one embodiment, the gutter assembly further comprises at least one bracket member sized and shaped to conform to the outer face of the gutter wall, each bracket member including front and rear bracket connecting portions connectable respectively to the front and rear gutter wall ends for attaching the bracket member to the gutter to form a gutter subassembly including the gutter and the at least one bracket member.

According to another aspect, there is also provided a gutter cover for covering the open top of a gutter, the gutter having a gutter wall extending between a front gutter wall end and a rear gutter wall end, the gutter wall defining a gutter channel having an open top, the gutter wall further having an inner face delimiting the gutter channel and an outer face, the gutter cover comprising: front and rear cover mounting portions; and a central cover portion extending between the front and rear cover mounting portions, the front cover mounting portion being engageable with the front gutter wall portion, and the rear cover mounting portion being engageable with the front gutter wall portion and the front connecting end of the bracket member to attach the gutter cover to the gutter, the front cover mounting portion including a face panel including a curved portion extending convexly frontwardly from the gutter.

In at least one embodiment, the front cover mounting portion includes a front receptacle comprising the face panel, the front receptacle further including a first segment extending upwardly and slightly forwardly from a front end of the central cover portion and a second segment extending upwardly and slightly rearwardly from the first segment, the first and second segments being angled relative to each other to form an apex therebetween.

In at least one embodiment, the front receptacle further includes an end segment extending upwardly and rearwardly from the curved portion of the face panel.

According to another aspect, there is also provided a gutter assembly comprising: a gutter having a gutter wall extending between a front gutter wall end and a rear gutter wall end, the gutter wall defining a gutter channel having an open top, the gutter wall further having an inner face delimiting the gutter channel and an outer face, the gutter wall having a first stiffness; at least one bracket member sized and shaped to conform to the outer face of the gutter wall, each bracket member including front and rear bracket connectors connectable respectively to the front and rear gutter wall ends for attaching the bracket member to the gutter to form a gutter subassembly including the gutter and the at least one bracket member, each bracket member having a second stiffness greater than the first stiffness such that attaching the at least one bracket member to the gutter stiffens the gutter to facilitate manipulation of the gutter.

DETAILED DESCRIPTION

Figure 1A:
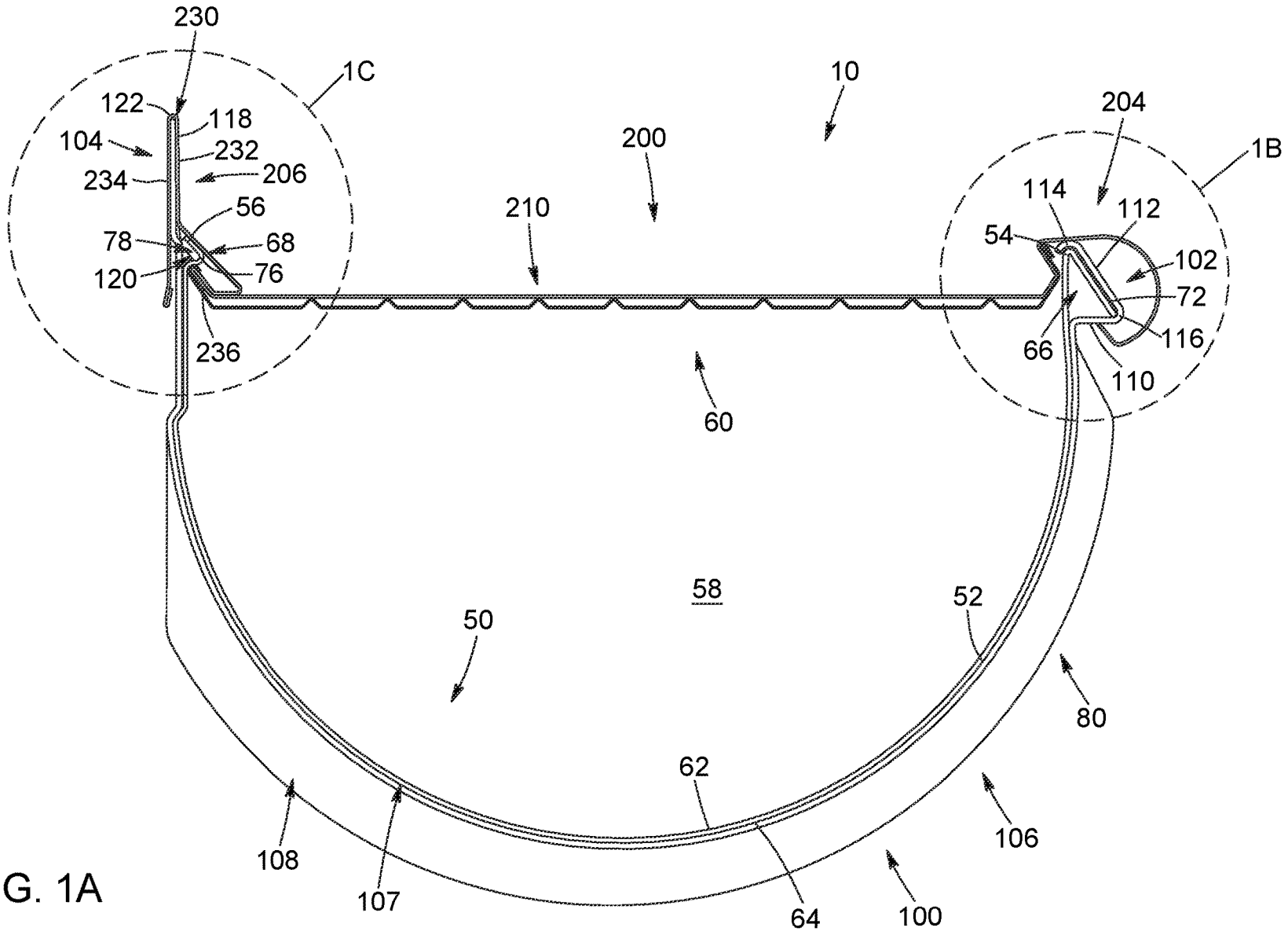
FIG. 1A is a cross-section view of a gutter assembly comprising a gutter with a gutter cover and a bracket member connected to the gutter, in accordance with one embodiment.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only. Moreover, it will be appreciated that positional descriptions such as "above", "below", "top", "bottom", "forward", "rearward" "left", "right" and the like should, unless otherwise indicated, be taken in the context of the figures and correspond to the position and orientation in the gutter, gutter cover and corresponding parts when being used. Positional descriptions should not be considered limiting.

Figure 1B:
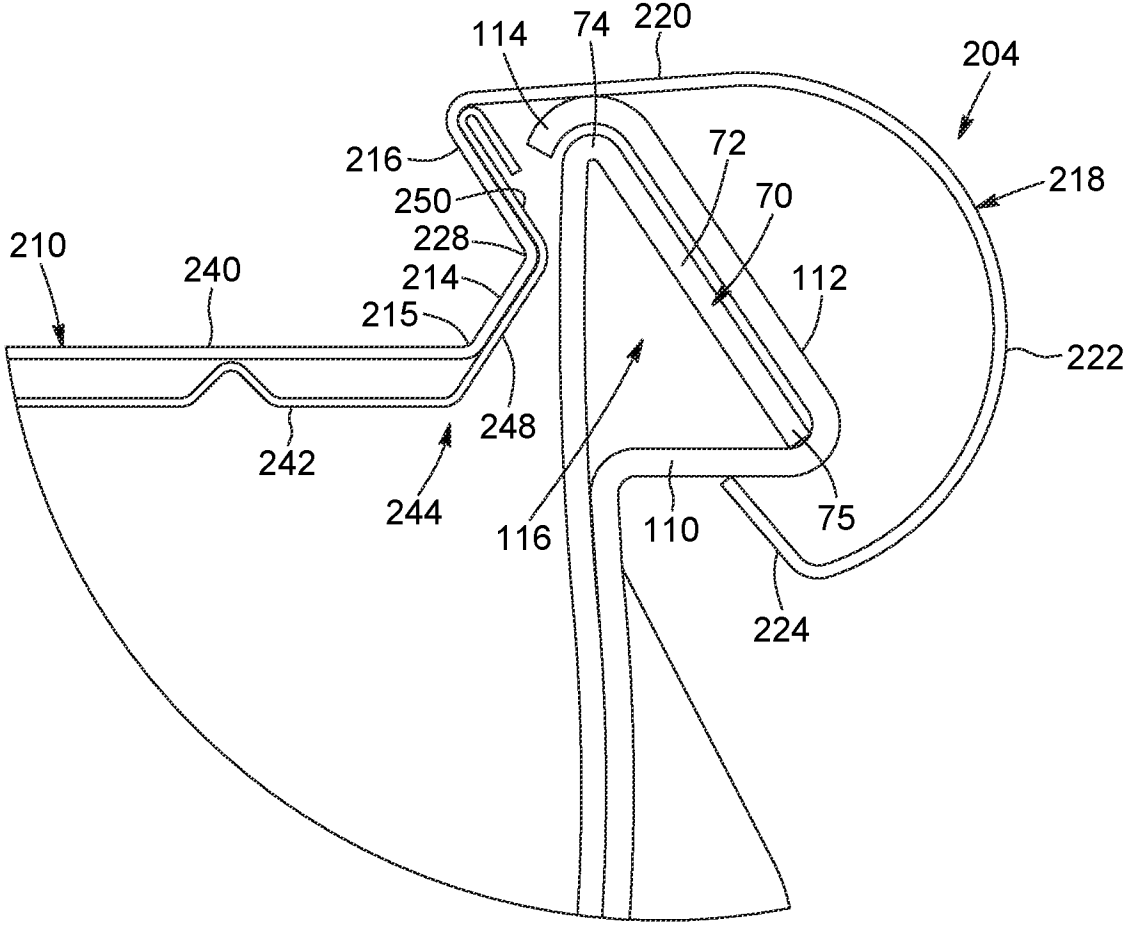
FIG. 1B is an enlarged portion, taken from area 1B, of the gutter assembly illustrated in FIG. 1A.
Figure 1C:
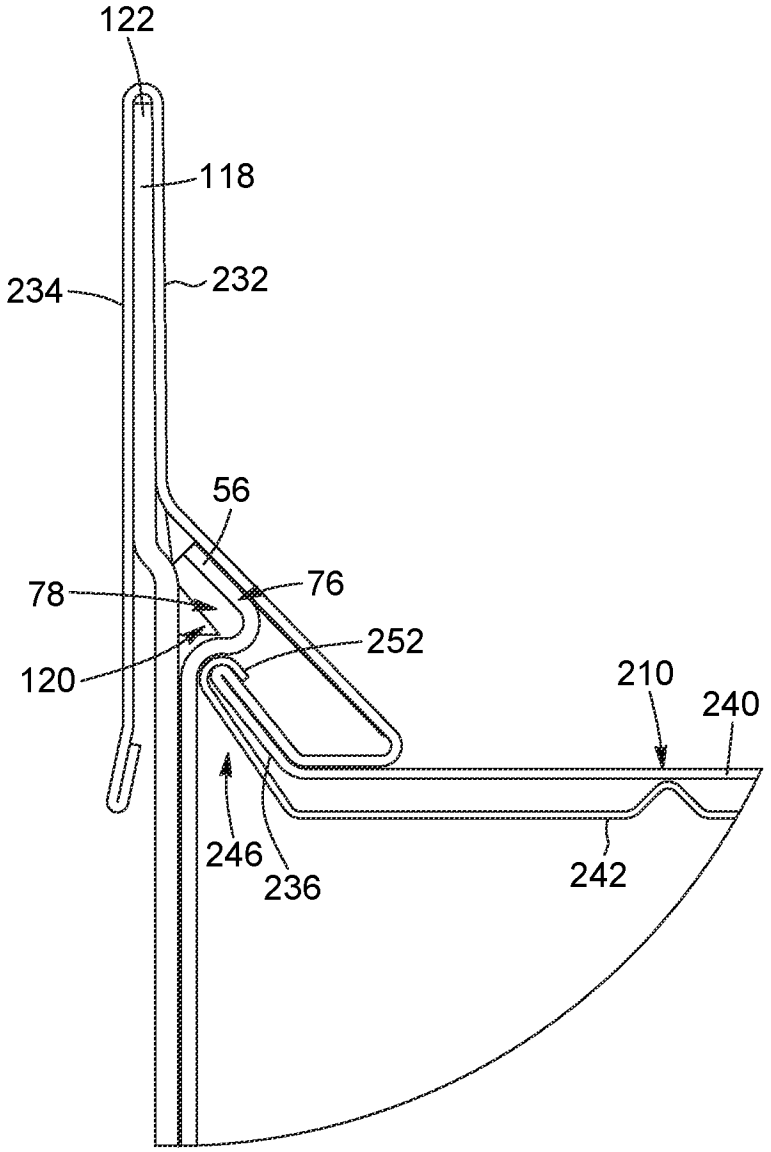
FIG. 1C is an enlarged portion, taken from area 1C, of the gutter assembly illustrated in FIG. 1A.
Figure 2:
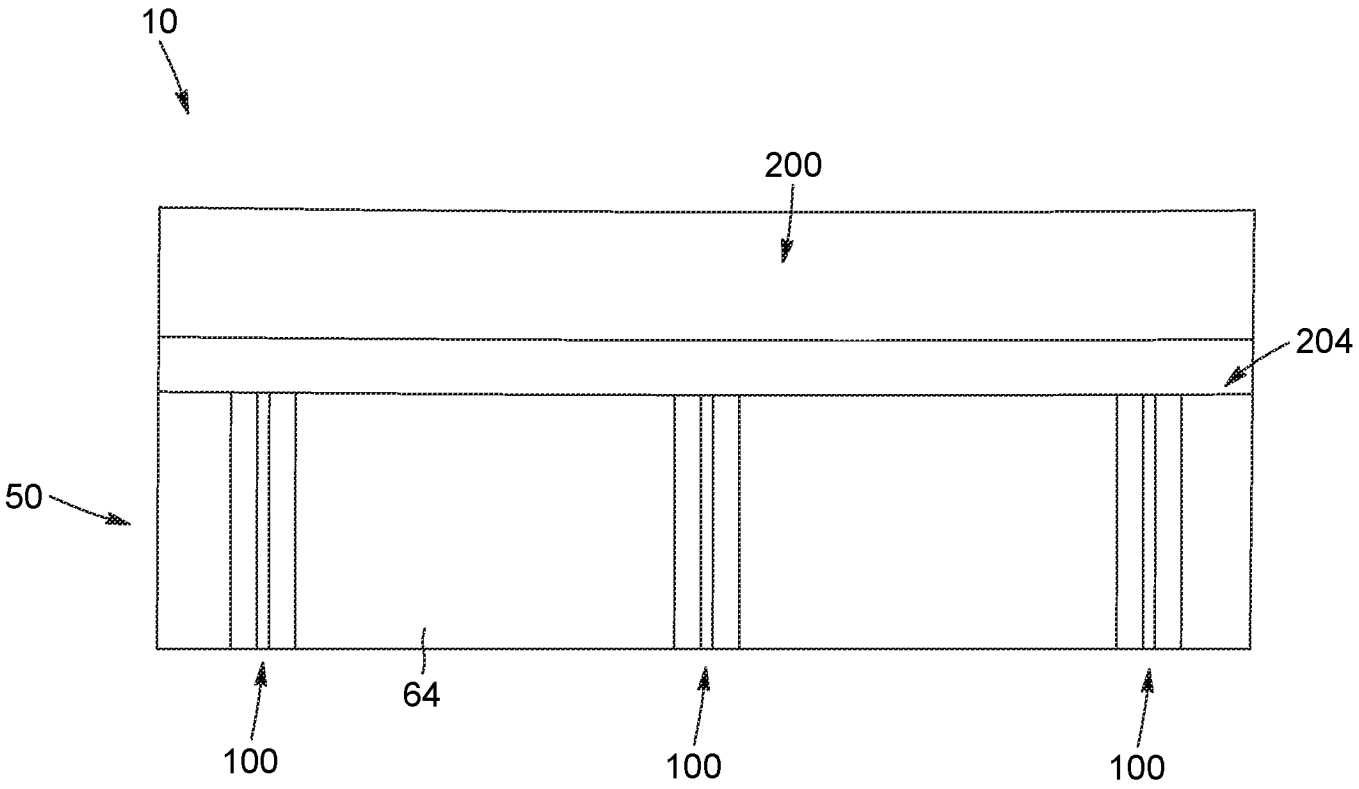
FIG. 2 is a front elevation view of the gutter assembly illustrated in FIG. 1A.

Referring to FIGS. 1A to 2, there is shown a gutter assembly 10, in accordance with one embodiment. The gutter assembly 10 includes a gutter 50, a plurality of bracket members 100 connected to the gutter 50 and a gutter cover 200 installed over the gutter 50.

In this embodiment, the bracket members 100 are connectable to the gutter 50 to form a bracketed gutter subassembly 80. Still in this embodiment, the bracket members 100 are configured to stiffen the gutter 50, such that the bracketed gutter subassembly 80 is easier to manipulate than the gutter 50 would be without the bracket members 100.

In the illustrated embodiment, the bracket members 100 may be configured to substantially have the appearance of mounting hooks, such as mounting hooks which are used in the art to secure a gutter to a supporting surface, such as a wall and/or a roof of a building. In prior systems, the mounting hooks would have had to be first aligned with each other and secured on the supporting surface. Since gutters are usually installed relatively high above a ground surface, this operation could be relatively difficult and time-consuming. The gutter would then have to be raised at the height of the mounting hooks and deposited on the mounting hooks in a separate operation, which again could be relatively time-consuming.

In the present embodiment, the bracket members 100 could be connected to the gutter 50 on or substantially near the ground surface to form the bracketed gutter subassembly 80, and the entire bracketed gutter subassembly 80 can then be raised at the desired distance above the ground surface. This would greatly simplify the installation of the bracket members 100 and the gutter 50, while allowing the user to benefit from the same visual appearance as conventional mounting hooks.

Still in the illustrated embodiment, once the bracketed gutter subassembly 80 has been formed, the gutter cover 200 can then be connected to the bracketed gutter subassembly 80. Specifically, the gutter cover 200 can be connected to the bracketed gutter subassembly 80 while the bracketed gutter subassembly 80 is still on or substantially near the ground surface, and the entire gutter assembly 10 including the bracketed gutter subassembly 80 with the gutter cover 200 connected thereto can then be raised at the desired distance above the ground surface and secured to the surface on which the gutter is to be installed.

Still referring to FIGS. 1A to 2, the gutter 50 includes a gutter wall 52 which extends between a front gutter wall end 54 and a rear gutter wall end 56. In the illustrated embodiment, the gutter wall 52 is curved, and more specifically, is semicircular. In the illustrated embodiment, the gutter wall 52 is made from a single piece of sheet metal that has been bent to the appropriate shape. In this configuration, the gutter wall 52 defines a gutter channel 58 having an open top 60. The gutter wall 52 further has an inner face 62 delimiting the gutter channel 58 and an outer face 64 extending opposite the inner face 62.

The gutter 50 further includes a front gutter connector 66 located at the front gutter wall end 54 and a rear gutter connector 68 located at the rear gutter wall end 56. The front gutter connector 66 is engageable with the bracket members 100 to connect the bracket members 100 and the gutter 50 together. In the illustrated embodiment, the front gutter connector 66 is substantially wedge-shaped and includes a front lip 70 which extends forwardly, i.e. away from the gutter channel 58, from the gutter wall 52 at the front gutter wall end 54. Specifically, the front lip 70 includes a front lip segment 72 which is substantially planar and which is folded at an acute angle relative to the gutter wall 52 such that the front lip segment 72 points substantially downwardly. As shown in FIG. 1, in this configuration, the front lip segment 72 extends between a front lip elbow 74 formed between the front lip segment 72 and the gutter wall 52, and a lip segment end 75.

Still in the illustrated embodiment, the rear gutter connector 68 includes a forwardly-extending bend 76 which extends forwardly from the gutter wall 52 at the rear gutter wall end 56. The forwardly-extending bend 76 is generally wedge-shaped and delimitates a rearwardly-facing recess 78. The forwardly-extending bend 76 and rearwardly-facing recess 78 are configured for attaching the gutter 50 to both the bracket members 100 and the gutter cover 200, as will be explained further below.

Still referring to FIGS. 1A to 2, each bracket member 100 is further curved, and more specifically semicircular, to conform to the outer face 64 of the gutter 50 when the bracket member 100 and the gutter 50 are connected together. Specifically, the bracket member 100 and the gutter 50 both have substantially the same radius of curvature.

In the illustrated embodiment, each bracket member 100 includes front and rear bracket connectors 102, 104 and a central bracket portion 106 extending between the front and rear bracket connectors 102, 104. The central bracket portion 106 includes a base panel 107 which is curved and extends along the outer face 64 of the gutter wall 52 and an outer rib member 108 which extends away from the base panel 107. More specifically, the outer rib member 108 is generally flat and extends substantially perpendicular to the base panel 107 to thereby stiffen the base panel 107 and maintain the curved shape of the base panel 107. In this configuration, the central bracket portion 106 therefore has a substantially T-shaped cross section. It will be understood that this configuration provides a relatively high stiffness to the bracket member 100. In comparison, the gutter wall 52 has a relatively lower stiffness. When the bracket members 100 are engaged with the gutter 50, the bracket members 100 therefore stiffen the gutter 50. It will be appreciated that a greater stiffness allows the gutter 50 to be manufactured into gutter pieces having a greater length without the gutter pieces bending as they are being manipulated and while still allowing the gutter 50 to be manufactured from a sheet of metal having a relatively small thickness. In other embodiments, other rib members or stiffening members could be used in addition to the outer rib member 108 or instead of the outer rib member 108. In yet another embodiment, instead of an outer rib member 108 or other stiffening members, the central bracket portion 106 could be configured in a configuration providing a relatively high stiffness. For example, the base panel 107 could be substantially thick or, instead of the base panel 107, the central bracket portion 106 could include a curved member which has a box cross-section or any other cross-section shape that would impart stiffness to the bracket member 100.

In the illustrated embodiment, the front bracket connector 102 is sized and shaped to receive the front gutter connector 66. Specifically, the front bracket connector 102 includes a bottom segment 110 extending frontwardly and substantially horizontally, an upright segment 112 extending upwardly and rearwardly from the bottom segment 110 and a hook member 114 extending rearwardly from the upright segment 112. The bottom segment 110 and the upright segment 112 together delimitate a substantially triangular connector receiving recess 116 sized and shaped to receive the substantially wedge-shaped front gutter connector 66 such that the front lip segment 72 extends along the upright segment 112 and the lip segment end 75 abuts a corner 116 defined between the bottom segment 110 and the upright segment 112. The hook member 114 is further substantially sized and shaped to receive therein the front lip elbow 74 of the front gutter connector 66 to prevent movement of the front gutter connector 66 relative to the front bracket connector 102. When the front gutter connector 66 is received in the front bracket connector 102, the front gutter connector 66 is therefore nested in the front bracket connector 102 and is entirely covered by the front bracket connector 102.

In the illustrated embodiment, the rear bracket connector 104 includes a vertical wall portion 118 and a forwardly-extending protrusion 120 defined in the vertical wall portion 118 and spaced downwardly from an upper end 122 of the vertical wall portion 118. The forwardly-extending protrusion 120 is sized and shaped to engage the rearwardly-facing recess 78 of the rear gutter connector 68 to thereby connect together the rear gutter connector 68 and the rear bracket connector 104. The forwardly-extending protrusion 120 may be formed into the rearwardly-facing recess 78 by clinching or press-joining the vertical wall portion 118 to the rear gutter connector 68. Alternatively, the rear bracket connector 104 could be secured to the rear gutter connector 68 using mechanical fasteners such as screws, rivets or the like, adhesive, by welding, by brazing or using any other suitable securing technique.

Referring now specifically to FIG. 2, in the illustrated embodiment, the bracket members 100 are spaced apart from each other along the gutter 50 in a longitudinal direction of the gutter 50. The bracket members 100 could be spaced from each other substantially evenly by a distance which provides a certain stiffness to the bracketed gutter subassembly 80, as explained above. In some embodiments, the gutter 50 could include some type of markings or indents, defined on the outer face 64 of the gutter wall 52 for example, which would provide an indication of locations at which the bracket members 100 may be positioned. Alternatively, the bracket members 100 could be positioned by the user according to a desired stiffness and/or a desired visual appearance of the gutter 50.

Referring again to FIGS. 1A to 2, the gutter cover 200 includes front and rear cover mounting portions 204, 206 configured for engaging respectively front and rear portions of the bracketed gutter subassembly 80 and a central cover portion 210 extending between the front and rear cover mounting portions 204, 206. Specifically, in the illustrated embodiment, the front cover mounting portion 204 is configured for engaging both the front gutter connector 66 and the front bracket connector 102 and the rear cover mounting portion is configured for engaging both the rear gutter connector 68 and the rear bracket connector 104.

In the illustrated embodiment, the front cover mounting portion 204 includes a front receptacle 212 sized and shaped to receive the front bracket connector 102 and the front gutter connector 66 therein. Specifically, the front receptacle 212 includes a first segment 214 extending upwardly and slightly forwardly from a front end 215 of the central cover portion 210, a second segment 216 extending upwardly and slightly rearwardly from the first segment 214, a face panel 218 having a straight top portion 220 extending forwardly from the first segment 214 and a curved portion 222 extending forwardly and downwardly from the straight top portion 220 and curving back rearwardly and downwardly, and an end segment 224 extending upwardly and rearwardly from the curved portion 222. When the front bracket connector 102 is received in the front receptacle 212, the front bracket connector 102 is held by an apex 228 formed between the first and second segments 214, 216 abutting the gutter wall 50 proximal the front gutter wall end 54, by the straight top portion 220 abutting the hook member 114 and the end segment 224 abutting the bottom segment 110 of the front bracket connector 102.

In the illustrated embodiment, the rear cover mounting portion 206 includes a bracket engaging portion 230 which has an inverted U-shape for straddling the upper end 122 of the vertical wall portion 118. Specifically, the bracket engaging portion 230 includes first and second vertical segments 232, 234 which are folded at a 180-degree angle relative to each other.

The rear cover mounting portion 206 further includes a hook portion 236 located below the bracket engaging portion 230 and engageable with the forwardly-extending protrusion 120 of the rear bracket connector 104. In the illustrated embodiment, the hook portion 236 is formed by a fold in the gutter cover 200 and extends rearwardly and upwardly so as to abut the forwardly-extending protrusion 120.

In the illustrated embodiment, the central cover portion 210 is substantially planar and has a plurality of drainage throughholes, not shown, defined therein to allow liquid such as rainwater to enter the gutter 50 through its open top 60. The drainage throughholes may be arranged according to any suitable pattern or configuration on the central cover portion 210, and may have any suitable shape and size.

In the illustrated embodiment, the central cover portion 210 is double-walled and includes an upper panel 240 and a lower panel 242 spaced vertically from the upper panel 240. In the illustrated embodiment, the upper panel 240 is integrally formed with the front and rear cover mounting portions 204, 206 and the lower panel 242 is provided as a distinct piece which is attachable to the upper panel 240 via front and rear lower panel connectors 244, 246. Still in the illustrated embodiment, the front lower panel connector 244 is configured to conform to the first and second segments 214, 216 of the front cover mounting portion 204. Specifically, the front lower panel connector 244 includes a first segment 248 extending upwardly and slightly frontwardly and a second segment 250 which extends upwardly and slightly rearwardly. The first and second segments 248, 250 are angled relative to each other at an angle which is substantially similar to the angle between the first and second segments 214, 216 of the front cover mounting portion 204. In this configuration, when the front lower panel connector 244 engages the front cover mounting portion 204, the first segment 248 of the lower panel connector 244 is parallel to and extends along the first segment 214 of the front cover mounting portion 204, and the second segment 250 of the lower panel connector 244 is parallel to and extends along the second segment 216 of the front cover mounting portion 204.

As shown in FIGS. 1A and 1B, when the lower panel 242 is connected to the upper panel 240 and the gutter assembly 10 is assembled, the front lower panel connector 244 is sandwiched between the first and second segments 214, 216 of the front cover mounting portion 204 and the gutter wall 52 proximal the front gutter wall end 54. In this configuration, it can still be said that the apex 228 defined between the first and second segments 214, 216 abuts the gutter wall 52 via the front lower panel connector 244, even though the apex 228 does not directly contact the gutter wall 52.

In the illustrated embodiment, the rear lower panel connector 246 is configured to engage the hook portion 236 of the rear cover mounting portion 206. Specifically, the rear lower panel connector 246 includes a hook member 252 which is sized and shaped to engage the hook portion 236. As shown in FIGS. 1A and 1C, when the lower panel 242 is connected to the upper panel 240 and the gutter assembly 10 is assembled, the hook member 252 is sandwiched between the hook portion 236 and the forwardly-extending protrusion 120 of the rear bracket connector 104. In this configuration, it can still be said that the hook portion 236 abuts the forwardly-extending protrusion 120 via the rear lower panel connector 246, even though the hook portion 236 does not directly abuts the forwardly-extending protrusion 120.

Alternatively, the central cover portion 210 may not be double-walled and may not include a lower panel, in which case the apex 228 defined between the first and second segments 214, 216 may abut and directly contact the gutter wall 52 and the hook portion 236 may abut and directly contact the forwardly-extending protrusion 120 of the rear bracket connector 104.

Figure 3:
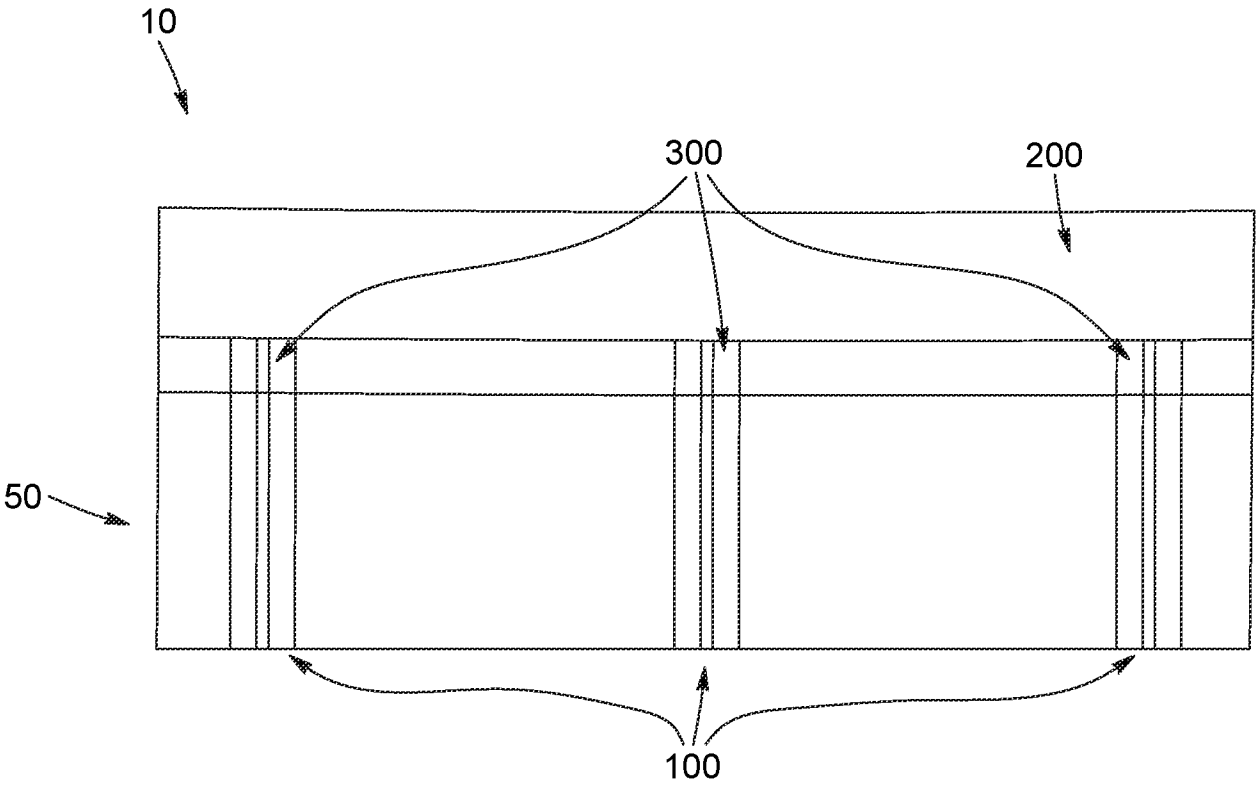
FIG. 3 is a front elevation view of a gutter assembly, in accordance with another embodiment, in which the gutter assembly further includes a plurality of bracket extension members attached to the gutter cover.

Referring to FIG. 3, in some embodiments, the gutter assembly 10 further includes a plurality of bracket extension members 300 which are distinct from the bracket members 100 and which are positionable in alignment with the bracket members 100 to form an upward extension to the bracket members 100 so as to provide the appearance that the bracket member 100 extend upwardly and over the curved portion 222 of the front cover mounting portion 204. In one embodiment, the bracket extension members 300 may be attachable to the front cover mounting portion 204. Specifically, the bracket extension members 300 could be clippable to the front cover mounting portion 204, or could be fastened thereto using one or more mechanical fasteners. In another embodiment, the bracket extension members 300 could instead integrally formed with the front cover mounting portion 204 or could be permanently secured thereto at desired locations corresponding to desired locations of the bracket member 100 along the gutter 50.

Figure 4:
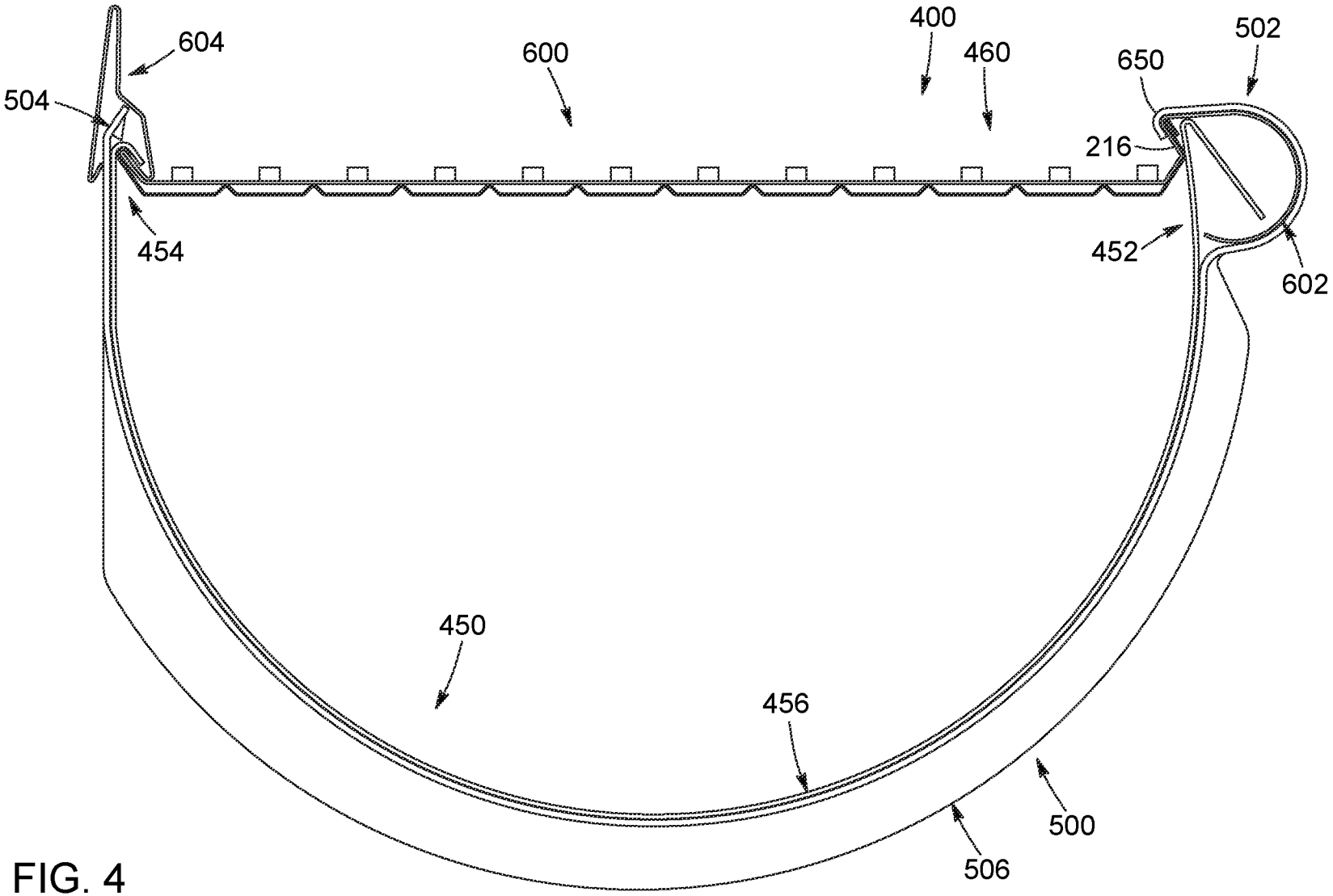
FIG. 4 is a cross-section view of a gutter assembly comprising a gutter with a gutter cover and a bracket member connected to the gutter, in accordance with another embodiment.

Turning now to FIG. 4, there is shown a gutter assembly 400, in accordance with another embodiment. In this embodiment, the gutter assembly 400 includes a gutter 450, a plurality of bracket members 500 and a gutter cover 600. Each bracket member 500 includes a front bracket connector 502, a rear bracket connector 504 and a central bracket portion 506 extending between the front and rear bracket connectors 502, 504. The gutter 450 includes a front gutter connector 452, a rear gutter connector 454 and a gutter wall 456 extending between the front and rear gutter connectors 452, 454. The gutter cover 600 includes a front cover mounting portion 602, a rear cover mounting portion 604 and a central cover portion 606 extending between the front and rear cover mounting portions 602, 604.

In this embodiment, the front gutter connector 452 is received in the front cover mounting portion 602 and the front cover mounting portion 602 is received in the front bracket connector 502. Specifically, the front bracket connector 502 is shaped to conform to the front cover mounting portion 602 and extends along an exterior of the front cover mounting portion 602. Specifically, the front bracket connector 502 entirely covers the front cover mounting portion 602. The front bracket connector 502 further terminates in a hook member 650 which engages the second segment 216 of the front cover mounting portion 602.

In the embodiment illustrated in FIG. 4, the front cover mounting portion 602 has a front mounting portion end 610 which does not contact the gutter wall 456 and is instead spaced therefrom. Alternatively, the front mounting portion end 610 could abut the gutter wall 456.

In this embodiment, to secure the gutter assembly 400 to a surface, instead of the bracket members being first attached to the gutter to form a bracketed gutter subassembly, the gutter cover 600 is instead first attached to the gutter 450 to form a covered gutter subassembly 460. The bracket members 500 can then be attached to the covered gutter subassembly 460, and the covered gutter subassembly 460 with the bracket members 500 attached thereto can be positioned at a desired location along the surface and secured to the surface.

Figure 5:
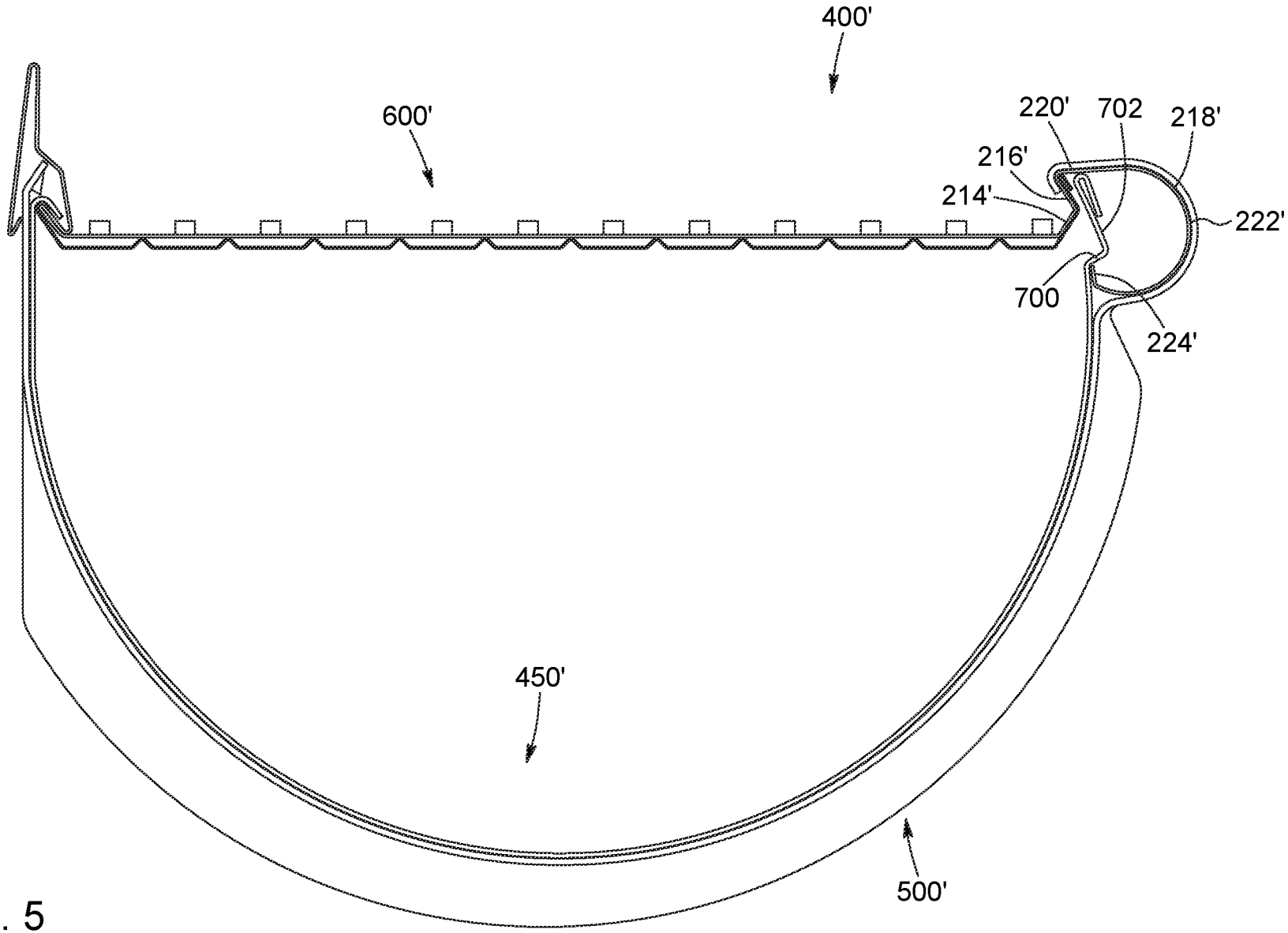
FIG. 5 is a cross-section view of a gutter assembly comprising a gutter with a gutter cover and a bracket member connected to the gutter, in accordance with yet another embodiment.

Referring now to FIG. 5, there is shown a gutter assembly 400', in accordance with yet another embodiment. The gutter assembly 400' includes a plurality of bracket members 500' which are substantially similar to the bracket members 500 described above and illustrated in FIG. 4. The gutter assembly 400' further includes a gutter 450' and a gutter cover 600' which are substantially similar to the gutter 450 and the gutter cover 600, except that the front gutter connector 452' and the front cover mounting portion 602' are slightly different than the front gutter connector 452 and the front cover mounting portion 602. Specifically, the front gutter connector 452' includes a lower segment 700 extending frontwardly and slightly upwardly and an upper segment 702 extending upwardly and rearwardly from the lower segment 700. In this embodiment, the front cover mounting portion 602' is substantially similar to the front cover mounting portion 204 described above and includes first and second segments 214', 216', a face panel 218' having a straight top portion 220' and a curved portion 222' extending forwardly and downwardly from the straight top portion 220 and curving back rearwardly and downwardly, and an end segment 224' extending upwardly and rearwardly from the curved portion 222'. In this embodiment, the end segment 224' abuts the lower segment 700 of the front gutter connector 452'.

Figure 6:
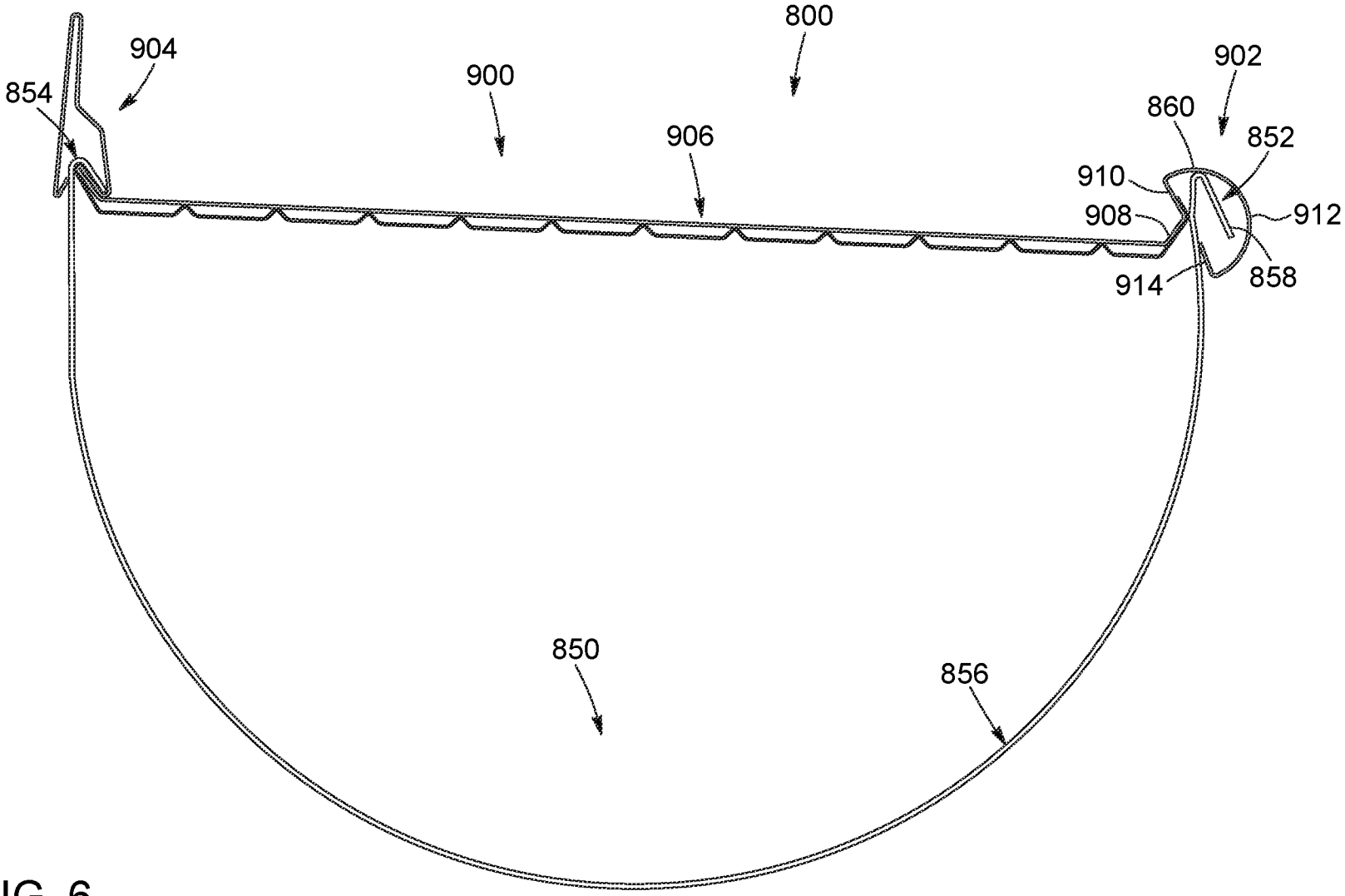
FIG. 6 is a cross-section view of a gutter assembly comprising a gutter with a gutter cover connected to the gutter, in accordance with one embodiment.

Turning to FIG. 6, there is shown a gutter assembly 800, in accordance with yet another embodiment. In this embodiment, the gutter assembly 800 includes a gutter 850 and a gutter cover 900. The gutter 850 is substantially similar to the gutter 50 described above and includes front and rear gutter connectors 852, 854 and a gutter wall 856 extending between the front and rear gutter connectors 852, 854. The front gutter connector 852 includes a front lip segment 858 bent at an angle to form a front lip elbow 860 between the front lip segment 858 and the gutter wall 856. Still in this embodiment, the gutter cover 900 is substantially similar to the gutter cover 200 described above and includes a front cover mounting portion 902, a rear cover mounting portion 904 and a central cover portion 906 extending between the front and rear cover mounting portions 904, 906. The front cover mounting portion 902 includes first and second segments 908, 910, a curved, substantially semicircular section 912 extending forward from the second segment 908 and an end segment 914 extending upwardly and rearwardly from the curved section 912. In this embodiment, when the front gutter connector 852 is received in the front cover mounting portion 902, the front lip elbow 860 abuts an interior of the curved section 912 and the end segment 914 abuts the gutter wall 856.

Although no bracket members are shown in FIG. 6, the gutter assembly 800 could further include a plurality of bracket members generally similar to the bracket members 500.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A gutter assembly securable to a supporting surface, the gutter assembly comprising:

a gutter having a gutter wall extending between a front gutter wall end and a rear gutter wall end, the gutter wall defining a gutter channel having an open top, the gutter wall further having an inner face delimiting the gutter channel and an outer face;

at least one bracket member sized and shaped to conform to the outer face of the gutter wall, each bracket member including front and rear bracket connectors connectable respectively to the front and rear gutter wall ends for attaching the bracket member to the gutter to form a bracketed gutter subassembly including the gutter and the at least one bracket member;

a gutter cover for covering the open top of the gutter along an entire length thereof, the gutter cover comprising front and rear cover mounting portions and a central cover portion extending between the front and rear cover mounting portions, the front cover mounting portion being engageable with at least one of the front gutter wall end and the front bracket connector, and the rear cover mounting portion being engageable with at least one of the rear gutter wall end and the rear bracket connector to attach the gutter cover to the bracketed gutter subassembly, the rear cover mounting portion having a first vertical segment and a second vertical segment which are folded at about 180 degrees relative to each other and defining a channel inbetween, the second vertical segment defining a substantially planar portion superposable against the supporting surface parallel to the supporting surface and securable thereto and having a section extending above the bracketed gutter subassembly when mounted to the supporting surface, wherein the rear bracket connector is located inside the channel defined between the first and second vertical segments when mounted to the supporting surface.

2. The gutter assembly as claimed in claim 1, wherein the at least one bracket member includes a plurality of bracket members disposed along the gutter and spaced apart from each other in a longitudinal direction and wherein the rear bracket connectors of each one of the bracket members extends above the central cover portion of the gutter cover when mounted to the supporting surface.

3. The gutter assembly as claimed in claim 1, wherein the gutter wall has a first stiffness and each bracket member has a second stiffness greater than the first stiffness such that the bracketed gutter subassembly is stiffer than the gutter.

4. The gutter assembly as claimed in claim 1, wherein the gutter wall is curved.

5. The gutter assembly as claimed in claim 4, wherein the gutter wall is substantially semicircular.

6. The gutter assembly as claimed in claim 1, wherein the gutter includes a front gutter connector engageable with the at least one bracket members to connect the gutter and the bracket members together.

7. The gutter assembly as claimed in claim 6, wherein the front cover mounting portion is configured for engaging both the front gutter connector of the gutter located at the front gutter wall end and the front bracket connector.

8. The gutter assembly as claimed in claim 7, wherein the front gutter connector includes a front lip extending frontwardly from the gutter wall at the front gutter wall end.

9. The gutter assembly as claimed in claim 8, wherein the front lip includes a front lip segment folded at an acute angle relative to the gutter wall at the front gutter wall end, thereby forming a front lip elbow between the front lip segment and the gutter wall.

10. The gutter assembly as claimed in claim 9, wherein the front lip segment extends forwardly and is folded downwardly.

11. The gutter assembly as claimed in claim 10, wherein the front bracket connector includes a hook member sized and shaped to receive therein the front lip elbow.

12. The gutter assembly as claimed in claim 11, wherein the front bracket connector further includes:

a bottom segment extending frontwardly; and an upright segment extending upwardly and rearwardly from the bottom segment, the hook member extending rearwardly from the upright segment.

13. The gutter assembly as claimed in claim 12, wherein the upright segment is angled relative to the bottom segment so as to extend against the front lip segment and parallel thereto when the front bracket connector engages the front gutter connector.

14. The gutter assembly as claimed in claim 7, wherein the front cover mounting portion includes a front receptacle sized and shaped to receive at least one of the front bracket connector and the front gutter connector therein.

15. The gutter assembly as claimed in claim 14, wherein the front cover mounting portion entirely covers the front gutter connector and the front bracket connector when the front gutter connector and the front bracket connector are engaged in the front cover mounting portion.

16. The gutter assembly as claimed in claim 15, wherein the front receptacle is sized and shaped to receive both the front bracket connector and the front gutter connector therein.

17. The gutter assembly as claimed in claim 16, wherein the front receptacle includes a plurality of segments, at least one of the plurality of segments abutting at least one of the gutter wall, the front gutter connector and the front bracket connector to hold the front gutter connector in the front receptacle.

18. The gutter assembly as claimed in claim 17, wherein the plurality of segments includes a first segment extending upwardly and slightly forwardly from a front end of the central cover portion and a second segment extending upwardly and slightly rearwardly from the first segment, the first and second segments being angled relative to each other to form an apex therebetween, the first and second segments being sized and shaped such that the apex abuts the gutter wall when the front gutter connector and the front bracket connector are received in the front receptacle.

19. The gutter assembly as claimed in claim 17, wherein the front receptacle further includes a face panel extending forwardly and downwardly and curving back rearwardly and downwardly, and an end segment extending upwardly and rearwardly from the curved portion, the end segment abutting the front bracket connector when the front bracket connector is received in the front receptacle.

20. The gutter assembly as claimed in claim 14, wherein the front bracket connector is shaped to conform to the front cover mounting portion and extends along an exterior of the front cover mounting portion.

21. The gutter assembly as claimed in claim 1, further including at least one extension member distinct from the bracket member and positionable in alignment with a corresponding one of the at least one bracket member to form an upward extension to the corresponding one of the at least one bracket member.

22. The gutter assembly as claimed in claim 21, wherein the bracket extension member is attachable to the front cover mounting portion.

23. A method for installing a gutter on a supporting surface, the gutter having a gutter wall extending between a front gutter wall end and a rear gutter wall end, the gutter wall defining a gutter channel having an open top, the method comprising:

attaching at least one bracket member to the gutter to form a bracketed gutter subassembly including the at least one bracket member and the gutter, each bracket member being sized and shaped to conform to an outer face of the gutter wall;

attaching a gutter cover, including a front cover mounting portion and a rear cover mounting portion, to the bracketed gutter subassembly by engaging the front and the rear cover mounting portions with respective front and rear portions of the bracketed gutter subassembly such that the gutter cover extends over an entire length of the open top of the gutter and covers said entire length, the rear cover mounting portion having a substantially planar portion superposable against the supporting surface, parallel to the supporting surface;

positioning the bracketed gutter subassembly including the gutter cover at a desired position by superposing the substantially planar portion of the rear cover mounting portion of the gutter cover against the supporting surface; and securing the bracketed gutter subassembly to the supporting surface with a section of the rear cover mounting portion extending above the bracketed gutter subassembly.

24. A gutter assembly comprising:

a gutter having a gutter wall extending between a front gutter wall end and a rear gutter wall end, the gutter wall defining a gutter channel having an open top, the gutter wall further having an inner face delimiting the gutter channel, an outer face, and a front gutter connector adjacent to the front gutter wall end ending with a lip segment end and extending continuously along the gutter wall;

a gutter cover for covering the open top of the gutter such that the gutter cover extends over an entire length of the open top of the gutter and covers said entire length, the gutter cover comprising front and rear cover mounting portions and a central cover portion extending between the front and rear cover mounting portions, the front cover mounting portion being engageable with the front gutter wall end and ending with an end segment, and the rear cover mounting portion being engageable with the rear gutter wall end along an entire length of the rear gutter wall end to attach the gutter cover to the gutter, the front cover mounting portion defining a front receptacle sized and shaped to receive at least partially the front gutter connector therein and including a face panel being curved to define a substantially semi-circular portion of the front receptacle, the face panel extending convexly frontwardly from the gutter, spaced-apart from the front gutter connector along at least 180 degrees, wherein the lip end segment of the front gutter connector is located at least partially forwardly of the end segment of the front cover mounting portion, inside the substantially semi-circular portion of the front receptacle.

25. The gutter assembly of claim 24 wherein an end of the face panel of the front cover mounting portion is spaced from the front gutter connector.

* * * * *